US005894043A

United States Patent [19]

Sood

[11] Patent Number: 5,894,043

[45] Date of Patent: Apr. 13, 1999

[54] HEM HOLDING DEVICE

[76] Inventor: Kathryn C. Sood, 79 Middleton Rd., Boxford, Mass. 01921

[21] Appl. No.: 08/866,947

[22] Filed: May 31, 1997

[51] Int. Cl.[6] ..... B32B 31/04

[52] U.S. Cl. ..... 428/99; 24/709.4; 24/355; 63/20; 223/DIG. 2

[58] Field of Search ..... 428/99, 120; 223/DIG. 2; 33/2 H; 24/709.4, 355, 511, 510; 63/20

[56] References Cited

U.S. PATENT DOCUMENTS

| | | | |
|---|---|---|---|
| 1,900,425 | 3/1933 | Benjamin | 63/20 |
| 2,833,014 | 5/1958 | Graham | 63/20 |
| 3,122,007 | 2/1964 | Horland | 63/20 |

*Primary Examiner*—Alexander Thomas
*Attorney, Agent, or Firm*—Don Halgren

[57] ABSTRACT

The invention thus comprises a hem holding device for the temporary shortening and raising of a hem line of an article of clothing by the wearer of that clothing. The device includes an elongated front panel having a first end, a second end, a front side and a rear side with a thin piercing pin extending off of the rear side of the front panel adjacent the first end thereof. A frame member has a proximal end extending off of the rear side of the front panel at the second end thereof, the frame member also having a distal end with a hinge thereon. A pivotable finger is attached to the hinge on the frame member, the finger having a first end in swingable engagement with the piercing pin, the finger also having a gripping surface defining a first plane. The rear side of the front panel defines a second plane, the first and second planes being parallel to one another to permit a folded article of clothing to be retained between the finger and the rearside of the front panel while being pierced by the piercing pin, without wrinkling or pinching the folded article of clothing therebetween. The front panel is at least three inches long. The pinching pin is at least three-eighths of an inch long to permit it to pierce several layers of folded clothing.

4 Claims, 1 Drawing Sheet

HEM HOLDING DEVICE

BACKGROUND OF THE INVENTION

1. Field of the Invention

This invention relates to functional jewelry which is utilized for the folding and supporting of hems of clothing.

2. Prior Art

The dictates of fashion often require that women wear high heels with dress slacks, long dresses, or gowns. In going to or coming from any particular event in which these long articles of clothing are worn, the woman will often wear flats or more comfortable shoes, instead of the high heels, which are proper fashion statement. During this time of wearing the lower-heeled shoes, the article of clothing, be it a pair of slacks, a dress or a gown, may often be too long to be comfortably worn while walking or riding. The bottom of the article of clothing may often become soiled, ripped, torn or caught on something around on the ground. When the wearer gets to the function to which she (or he) is going, the article of clothing may be soiled or damaged, and in any case an unsightly appearance may have to be made. One way of avoiding this problem, is to bring an extra change of clothing and change at the function to which one is going. This of course is unnecessarily burdensome.

Another approach is to lift one's slack legs, dress or article of clothing bottom as one walks or rides in the car or goes to the function. This requires a great deal of effort and a lot of attention. This should not be so.

It is an object of the present invention, to provide a simple device which will maintain the hems and lower portions of a long article of clothing such as dress slacks, a dress, or a gown, from getting sullied, worn, or torn while going to or from a function to which one is attending.

It is yet a further object of the present invention, to provide such a functional device with an attractive jewelry configuration, while avoiding any harm to the garment by virtue of such holding.

It is still yet a further object of the present invention, to provide a functional article of jewelry, which decorativeness may be changed and accommodated while still being utilized to hold the hem of an article of clothing.

BRIEF SUMMARY OF THE INVENTION

The present invention comprises a hem holder device for safely containing and supporting, in a folded manner, the lowermost portions of an article of clothing, such as a dress, a pair of dress slacks, or a gown. The lowermost hem of the article of clothing is kept in this folded manner for a temporary period to permit the wearer to keep the article of clothing from being ripped, torn, or sullied by touching the pavement or the ground when the wearer may not be wearing high-heeled shoes.

The hem holding device of the present invention includes an elongated outer panel, critically at least three inches in length. This elongated panel has an outwardly directed first surface, the panel having an upper end and a lower end. The elongated panel also has a second, inner or rearwardly directed surface. An elongated piercing pin critically at least five-sixteenths of an inch long, for best piercing, extends from a midline area of the second, inner surface, about on half inch from the uppermost end of the elongated panel.

A frame end member is critically attached to the lower end of the inner surface. This lowermost attachment permits maximum entry of the folded hem portion of clothing into the "mouth" of this hem holding device. The frame end member has a distal end with a hinge thereon. A pivotable finger is attached to the hinge. The pivotable finger has a distal end which extends beyond the elongated piercing pin. The juxtaposition of the pivotable finger and the piercing pin permits the pivotable finger to biasedly rest against the distal end of piercing pin. The pivotable finger is attached to the frame member through an axis at the hinge. A spring is arranged between the pivotable finger and the frame member, so as to permit a biasing force to keep the distal end of the pivotable finger biased towards and against the tip of the piercing pin extending from the rearside of the elongated panel. The pivotable elongated finger has a gripping surface, the engaging collection of points thereof, defines a plane.

The inner surface of the elongated panel also defines a surface plane. It is a critical feature of the present invention, that the inner surface plane and the plane defined by the gripping surface of the elongated finger be parallel to one another and to be spaced at least three-sixteenths to one-half inch apart.

It is a further critical feature of the present invention as aforementioned, that the pivotable finger be attached to a frame member which frame member is secured to the lowermost portion of the elongated panel. This permits the greatest amount of hem to be captured between the "mouth" defined by the pivotable finger and the elongated front panel.

The pivotable finger is required to be swingable on its hinge so as to open wide enough so as to permit a multiple fan fold of clothing material to be held between the elongated front panel and the pivotable finger.

In a preferred embodiment of the pivotable finger, in a view taken along the transverse axis, the pivotable finger is of a generally "U"-shape, thus comprising an elongated "U"-shaped channel. This "U"-shaped channel helps engage the tip of the piercing pin and lock it into place, and a plurality of folds of clothing are pierced thereby.

In a further embodiment of the present invention, it is contemplated that the front panel may have decorative articles which may be attached to the front outer surface thereof. The decorative articles may be attached by an adhesive, by a screw means attached to the front panel, or by a mating/groove sliding fit.

In operation of the present hem holding device, the user would make a fold at the lowermost end of her/his article of clothing, so as to define a new hem of at least likely several inches in length higher than the existing hem, and that hem is thereby placed into the "mouth" defined by the pinched open pivotable finger and the front panel. The temporary hem being now two or possibly three layers of clothing thick, being pierced by the piercing pin, and being held securely thereto by the release of the elongated finger, which is then biased toward the distal end of the piercing pin.

Thus the hem holding device is permitted to temporarily and neatly hold multiple layers of folded clothing with a biasing arrangement as well as simultaneously with a thin piercing pin arrangement. Upon desiring to return to the original length of the article of clothing, the wearer merely reopens the hem holding device by biasing outwardly on the lowermost extension of the elongated pivotable finger, so as to permit the mouth to reopen between the front panel and the pivotable finger, thereby permitting the layers of clothing to be removed from their piercing configuration from the thin piercing pin and the hem holding device removed therefrom.

The invention thus comprises a hem holding device for the temporary shortening and raising of a hem line of an article of clothing by the wearer of that clothing. The device includes an elongated front panel having a first end, a second end, a front side and a rear side with a thin piercing pin extending off of the rear side of the front panel adjacent the first end thereof. A frame member has a proximal end extending off of the rear side of the front panel at the second end thereof, the frame member also having a distal end with a hinge thereon. A pivotable finger is attached to the hinge on the frame member, the finger having a first end in swingable engagement with the piercing pin, the finger also having a gripping surface defining a first plane. The rear side of the front panel defines a second plane, the first and second planes being parallel to one another to permit a folded article of clothing to be retained between the finger and the rearside of the front panel while being pierced by the piercing pin, without wrinkling or pinching the folded article of clothing therebetween. The front panel is at least three inches long. The pinching pin is it least five-sixteenths of an inch long to permit it to pierce several layers of folded clothing. The pivotable finger is of generally "U" shape in cross-section to permit aligned engagement with the piercing pin. The frame member comprises a strut having a first end attached at the lowermost end of the front panel. A removable decorative panel may be secured to the front side of the front panel, to permit a wearer of the device to decorate the device as desired.

The invention also includes a method for the temporary shortening and raising of a hem line of an article of clothing, comprising the steps of: arranging a hem holding device having an elongated front panel having a first end, a second end, a front side and a rear side with a thin piercing pin extending off of the rear side of the front panel adjacent the first end thereof; securing a frame member having a proximal end extending off of the rear side of the front panel at the second end thereof, the frame member also having a distal end with a hinge thereon, with a pivotable finger attached to the hinge on the frame member, the finger having a first end in swingable engagement with the piercing pin, the finger having a gripping surface defining a first plane; and biasing the pivotable finger away from the front panel to separate the first ends of the front panel and the pivotable finger, so as to permit a folded article of clothing to be inserted therebetween, to permit a shorter hem to be temporarily placed thereon. The method includes the steps of arranging the rear side of the front panel so as to define a second plane, the first and second planes being parallel to one another to permit a folded article of clothing to be retained between said finger and the rearside of the front panel while being pierced by the piercing pin, without wrinkling or pinching the folded article of clothing therebetween; extending the piercing pin to a length of at least five sixteenths of an inch, so as to permit the piercing pin to extend through at least two layers of clothing; and attaching a removable decorative panel to the front side of the front panel to provide a particular desired decoration thereon, by a wearer of the hem holding device.

BRIEF DESCRIPTION OF THE DRAWINGS

The objects and advantages of the present invention will become more apparent, when viewed in conjunction with the following drawings in which.

DETAILED DESCRIPTION OF THE PREFERRED EMBODIMENTS

Figure 1:
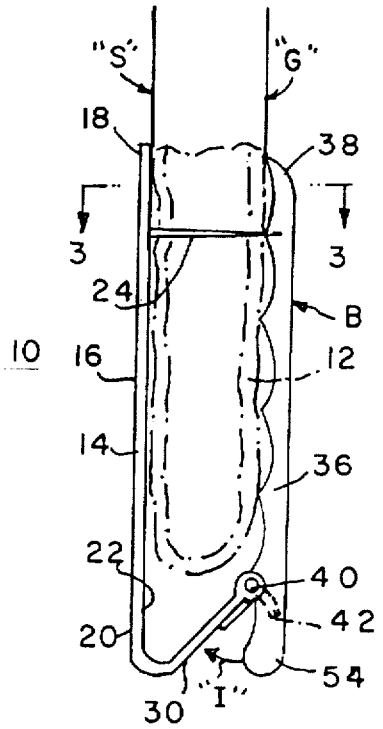
FIG. 1 is a side elevational view of a hem holding device constructed according to the principles of the present invention.

Referring now to the drawings in detail, and particularly to FIG. 1, there is shown a hem holder device 10 for safely containing and supporting, in a folded manner, the lowermost portions of an article of clothing 12, (shown in phantom in FIG. 1) such as a dress, a pair of dress slacks, or a gown. The lowermost hem of the article of clothing 12 is kept in this folded manner for a temporary period to permit the wearer to keep the article of clothing 12 from being ripped, torn, or sullied by touching the pavement or the ground when the wearer may not be wearing high-heeled shoes.

The hem holding device 10 of the present invention includes an elongated outer panel 14, critically at least three inches in length, and about at least one-half of an inch wide. This elongated panel 14 has an outwardly directed first surface 16, the elongated panel 14 also having an upper end 18 and a lower end 20. The elongated panel 14 has a second, inner or rearwardly directed surface 22. An elongated piercing pin 24, critically at least five-sixteenths of an inch long, (sufficient to pierce several thicknesses of folded clothing material) extends from a midline area of the second, inner surface 22, about on half inch from the uppermost end of the elongated panel.

Figure 2:
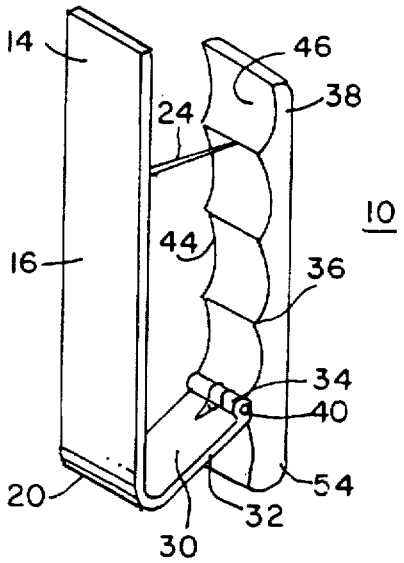
FIG. 2 is a perspective view of a hem holding device similar to that shown in FIG. 1.

A frame end member 30 is critically attached to the lower end 20 of the inner surface 22, as shown in FIGS. 1 and 2. This lowermost attachment permits maximum entry of the folded hem portion of clothing 12 into the "mouth" of this hem holding device 10. The frame end member 30 has a distal end 32 with a hinge 34 thereon. A pivotable finger 36 is attached to the hinge 34. The pivotable finger 36 has a distal end 38 which extends beyond the elongated piercing pin 24. The juxtaposition of the pivotable finger 36 and the piercing pin 24 permits the pivotable finger 36 to biasedly rest against the distal end of piercing pin 24. The pivotable finger 36 is attached to the frame end member 30 through an axis 40 at the hinge 34 A spring 42 is arranged between the pivotable finger 36 and the frame end member 30, so as to permit a biasing force (as shown by arrow "B" in FIG. 1), to keep the distal end 38 of the pivotable finger 36 biased towards and against the tip of the piercing pan 24 extending from the rearside 22 of the elongated panel 14. The pivotable elongated finger 36 has a cloth engaging gripping surface 44, the engaging collection of points thereof, defining a plane "G", as shown in FIGS. 1 and 3.

Figure 3:
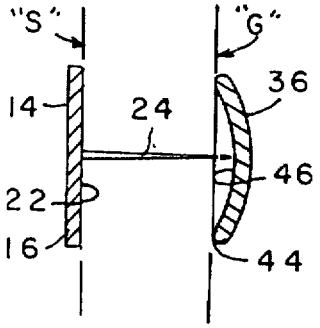
FIG. 3 is a view taken along the lines 3—3 of FIG. 1.

The rearside or inner surface 22 of the elongated panel 14 also defines a surface plane "S", as shown in FIGS. 1 and 3. It is a critical feature of the present invention, that the inner surface plane "S" and the plane "G" defined by the gripping surface 44 of the elongated pivotable finger 36 be parallel to one another and to be spaced at least three-sixteenths to one-half inch apart.

It is a further critical feature of the present invention as aforementioned, that the pivotable finger 36 be attached to the frame member 30, which frame end member 30 is secured to the lowermost portion of the elongated panel 14, as shown in FIG. 1. This permits the greatest amount of hem to be captured between the "mouth" defined by the pivotable finger 36 and the elongated front panel 14.

The pivotable finger 36 is required to be swingable on its hinge 34 so as to open wide enough so as to permit a multiple fan fold of clothing material 12 to be held between the elongated front panel 14 and the pivotable finger 36.

In a preferred embodiment of the pivotable finger 36, in a view taken along the transverse axis, as shown in FIG. 3, the pivotable finger 36 is of a generally "U"-shape in cross section, thus comprising an elongated "U"-shaped channel 46. This "U"- shaped channel 46 helps engage the tip of the piercing pin 24 and lock it into place, and a plurality of folds of clothing 12 may be solidly and securely pierced and held in place with minimal damage thereby.

Figure 4:
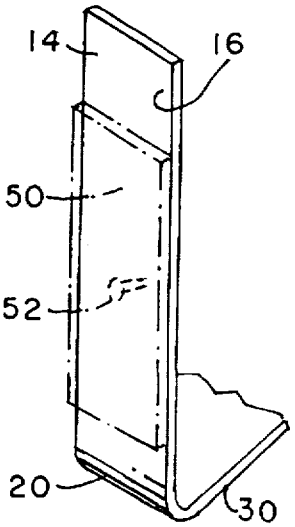
FIG. 4 is a partial-perspective view of a hem holding device with a decorative attachment secure.d to the front panel thereof.

In a further embodiment of the present invention, as shown in FIG. 4, it is contemplated that the front panel 14 may have a decorative article 50 which may be attached to the front outer surface 16 thereof. The decorative articles 50 may be attached by semi-aggressive adhesive, or by a screw means 52 attached to the front panel 14.

In operation of the present hem holding device 10, the user would make a fold at the lowermost end of her/his article of clothing 12, so as to define a new hem of at least likely several inches in length higher than the existing hem, and that hem is thereby placed into the "mouth" defined by the pinched open pivotable finger 36 and the front panel 14. The temporary hem being now two or possibly three layers of clothing 12 thick, being pierced by the piercing pin 24, and being held securely thereto by the wearer's release of the thumb tab 54 on the lower or first end 56 of the elongated pivotable finger 36, which second or distal end 38 of the pivotable finger 36 is then biased toward the distal end of the piercing pin 24.

Thus the hem holding device 10 is permitted to temporarily and neatly hold multiple layers of folded clothing 12 with a biasing arrangement as well as simultaneously with a thin piercing pin arrangement. Upon desiring to return to the original length of the article of clothing, the wearer merely re-opens the hem holding device 10 by biasing onto the lowermost thumb tab 54, (as shown by the arrow "T" in FIG. 1) of the elongated pivotable finger 36, so as to permit the mouth to reopen between the front panel 14 and the pivotable finger 36, thereby permitting the layers of clothing 12 to be removed from their piercing configuration from the thin piercing pin 24 and the hem holding device 10 removed therefrom.

I claim:

1. A method for the temporary shortening and raising of a hem line of an article of clothing, comprising the steps of:

arranging a hem holding device having an elongated front panel having a first end, a second end, a front side and a rear side with a thin piercing pin extending off of said rear side of said front panel adjacent said first end thereof;

securing a frame member having a proximal end extending off of said rear side of said front panel at said second end thereof, said frame member also having a distal end with a hinge thereon, with a pivotable finger attached to said hinge on said frame member, said finger having a first end in swingable engagement with said piercing pin, said finger having a gripping surface defining a first plane;

biasing said pivotable finger away from said front panel to separate said first ends of said front panel and said pivotable finger, so as to permit a folded article of clothing to be inserted therebetween, to permit a shorter hem to be temporarily placed thereon and inserting a folded article of clothing between said front panel and said pivotable finger to provide a shorter hem on said article of clothing.

2. The method for the temporary shortening and raising of a hem line of an article of clothing as recited in claim 1, comprising the steps of:

arranging said rear side of said front panel so as to define a second plane, said first and second planes being parallel to one another to permit a folded article of clothing to be retained between said finger and said rearside of said front panel while being pierced by said piercing pin, without wrinkling or pinching said folded article of clothing therebetween.

3. The method for the temporary shortening and raising of a hem line of an article of clothing, as recited in claim 1, including the step of:

extending said piercing pin to a length of at least three-eighths of an inch, so as to permit said piercing pin to extend through at least two layers of clothing.

4. The method for the temporary shortening and raising of a hem line of an article of clothing, as recited in claim 3, including the step of:

replacing a readily removable decorative panel to said front side of said front panel to provide a particular desired decoration thereon, by a wearer of said hem holding device.

* * * * *